US006145662A

United States Patent [19]

Newton

[11] Patent Number: 6,145,662

[45] **Date of Patent: *Nov. 14, 2000**

[54] TOOL CARRIER

[76] Inventor: Harold L. Newton, 20000 SW. 224 St., Goulds, Fla. 33170-3209

[ * ] Notice: This patent issued on a continued prosecution application filed under 37 CFR 1.53(d), and is subject to the twenty year patent term provisions of 35 U.S.C. 154(a)(2).

[21] Appl. No.: 09/249,987

[22] Filed: Feb. 13, 1999

[51] Int. Cl.[7] ..... B65D 85/28

[52] U.S. Cl. ..... 206/373; 206/483; 206/376; 206/379; 211/70.6

[58] Field of Search ..... 206/376, 377, 206/375, 493, 478, 480, 483, 564, 565, 557, 214; 211/70.6, 71; 220/768, 752

[56] References Cited

U.S. PATENT DOCUMENTS

| | | | |
|---|---|---|---|
| D. 169,077 | 3/1953 | Mains, Jr. | D80/9 |
| 3,532,221 | 10/1970 | Kaluhiokalani et al. | 211/60 |
| 5,284,245 | 2/1994 | Silvon et al. | 206/378 |
| 5,358,692 | 10/1994 | Reynolds | 422/104 |
| 5,409,560 | 4/1995 | Hammer et al. | 156/248 |
| 5,544,744 | 8/1996 | Oman | 206/319 |
| 5,573,116 | 11/1996 | Zink | 206/378 |

*Primary Examiner*—Paul T. Sewell
*Assistant Examiner*—Nhan T. Lam
*Attorney, Agent, or Firm*—Alvin S. Blum

[57] ABSTRACT

A tool carrier is disclosed. The tool carrier is provided with a lower rectilinear support having an upper plate and a lower plate. Each of the plates has a long length and a short width. Side plates are located there between for forming an opening through the support. The upper surface of the upper plate forms a lower recipient surface. An upper rectilinear support has an upper plate and a lower support plate. Each of the plates has a long length and a short width. Side plates between the upper and lower support plates form an opening. The upper surface of the upper plate forms a lower recipient surface. The length and width of the upper support is less than that of the lower support. A handle is operatively coupled to the upper surface of the upper support.

14 Claims, 5 Drawing Sheets

TOOL CARRIER

BACKGROUND OF THE INVENTION

Field of the Invention

The present invention relates to article carriers, and more specifically to a handled carrier for an assortment of socket wrenches and other wrenches and tools that may fit into a toolbox.

This application is an improvement application over my prior application, Ser. No. 09/020,498 filed Feb. 9, 1998 and issued Dec. 15, 1998 as U.S. Pat. No. 5,848,694.

Conventional tool boxes may be provided with a handled tray that fits inside the box and is supported above the box contents in the upper portion of the box by ridges or projections from the box sides. In addition to the many tools that the mechanic usually carries in a toolbox, there is often a need for wrenches of various types and sizes. End wrenches come in various sizes and styles including open end, adjustable open end, box, and combinations thereof. These may be provided in a set in a specially compartmented box or purchased separately and stowed in the toolbox. Socket wrenches are generally purchased and carried in a set that is provided in a box with a special recess for each socket so that a correct size is easily selected. Recesses hold the various wrench handles and attachments for the sockets. Upsetting the box may mix and scatter the contents. It is awkward and inconvenient for a person to carry a toolbox and also a socket wrench box and an end wrench box.

SUMMARY OF THE INVENTION

It is accordingly an object of the invention to provide a new and improved tool carrier system comprising, in combination, a lower rectilinear support having an upper plate and a lower plate, each of the plates having a long length and a short width and with side plates there between for forming an opening through the support, the upper surface of the upper plate forming a recipient surface. An upper rectilinear support has an upper plate and a lower plate. Each of the plates has a long length and a short width. Side plates there between form an opening through the support. The upper surface of the upper plate forms a recipient surface. The length and width of the upper support are less than that of the lower support. Next provided is a handle. The handle is of a hollow cylindrical configuration to form a central opening there within. Arms extend downwardly from the handle. The arms are coupled to the upper surface of the upper support adjacent to the ends of the upper support. The length of the handle is less than the length of the upper surface of the upper support. The handle, lower support and upper support are fabricated of plastic. A plurality of elongated support elements are affixed to each side of the upper surface of the lower support laterally offset from the upper support. A plurality of receivers are slidably supported along the support elements and provided with spring bias elements. In this manner sockets are securely held on the receivers. A web bearing upstanding resilient fibers is mounted on the lower surface of the openings through the lower support and upper support and within the interior surface of the handle. The web functions to removably receive and slidably support tools. A generally rectilinear container with rows and columns of cylindrical openings is next provided. The openings each have vertical axes and a central slot for the removable receipt of bits.

These and other objects, advantages and features of the invention will become more apparent when the detailed description is studied in conjunction with the drawings in which like reference characters designate like elements in the various drawing figures.

It is therefore an object of the present invention to provide a new and improved tool carrier which has all of the advantages of the prior art tool carriers and none of the disadvantages.

It is another object of the invention to carry tools in a support which precludes the spilling of tools.

It is another object of the present invention to provide a new and improved tool carrier which may be easily and efficiently manufactured and marketed.

It is further object of the present invention to provide a new and improved tool carrier which is of durable and reliable constructions.

It is a further object of the invention to support tools in an easily accessible manner.

An even further object of the present invention is to provide a new and improved tool carrier which is susceptible of a low cost of manufacture with regard to both materials and labor, and which accordingly is then susceptible of low prices of sale to the consuming public, thereby making such tool carrier economically available to the buying public.

Lastly, it is an object of the present invention to provide a new and improved tool carrier, a tool carrier provided with a lower rectilinear support having an upper plate and a lower plate. Each of the plates has a long length and a short width. Side plates are located there between for forming an opening through the support. The upper surface of the upper plate forms a lower recipient surface. An upper rectilinear support having an upper plate and a lower support plate, each of the plates having a long length and a short width and with side plates therebetween for forming an opening, the upper surface of the upper plate forming a lower recipient surface, the length and width of the upper support being less than that of the lower support; and lastly provided a handle operatively coupled to the upper surface of the upper support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 3:
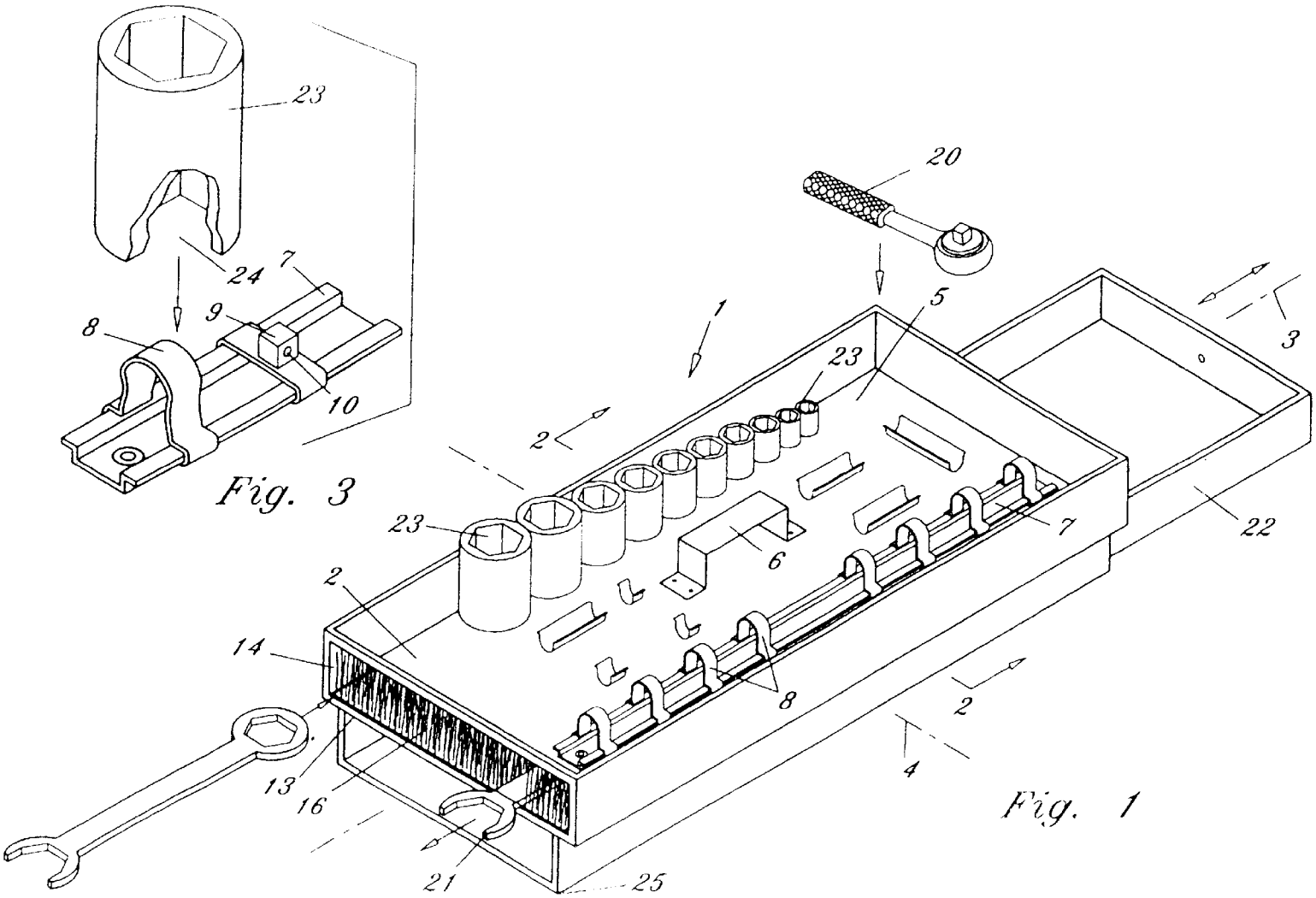
FIG. 1 is a top perspective view of the tool carrier constructed in accordance with the principles of the present invention.
FIG. 3 is a detail perspective view of two different socket receivers slidably mounted on a support element.
Figure 2:
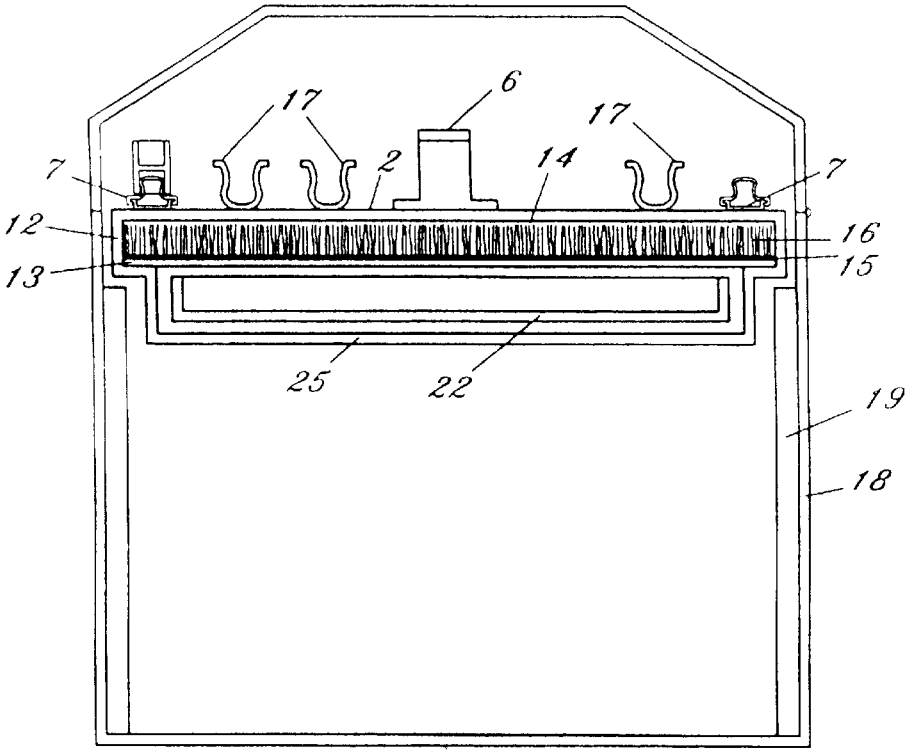
FIG. 2 is a sectional view through line 2—2 of FIG. 1 showing the tool carrier inside a toolbox.
Figure 5:
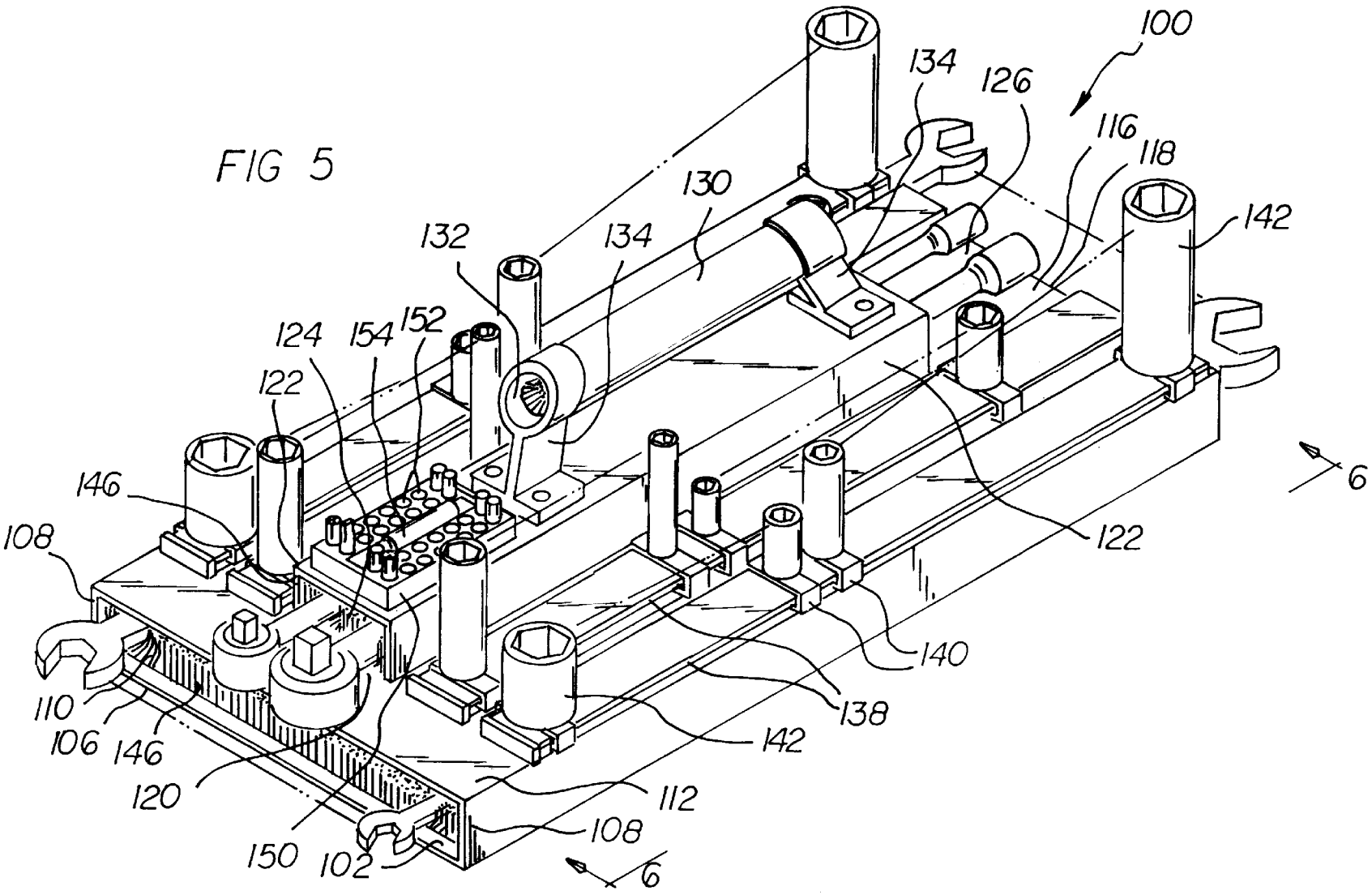
FIG. 5 is a perspective illustration of an alternate embodiment of the invention.
Figure 6:
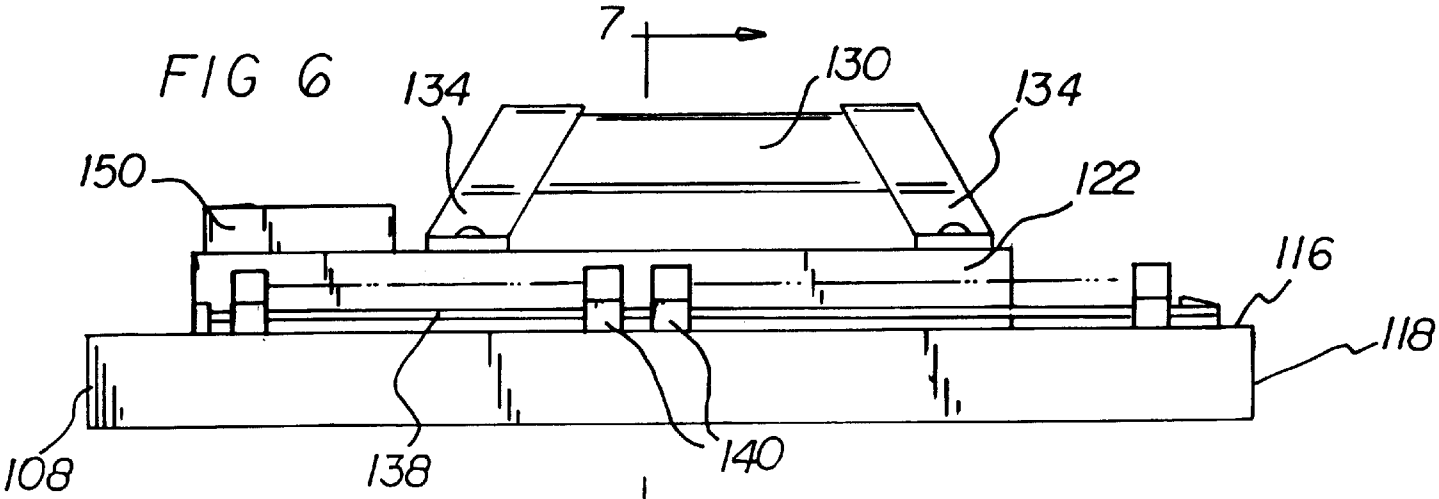
FIG. 6 is a side elevational view taken along line 2—2 of FIG. 1.
Figure 7:
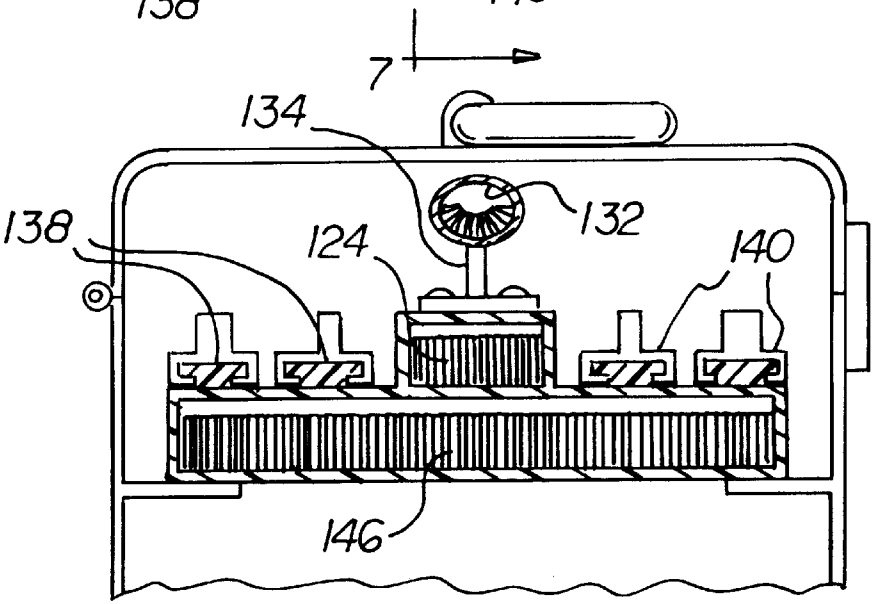
FIG. 7 is a cross-sectional view taken along line 3—3 of FIG. 6.
Figures 8, 9, 10:
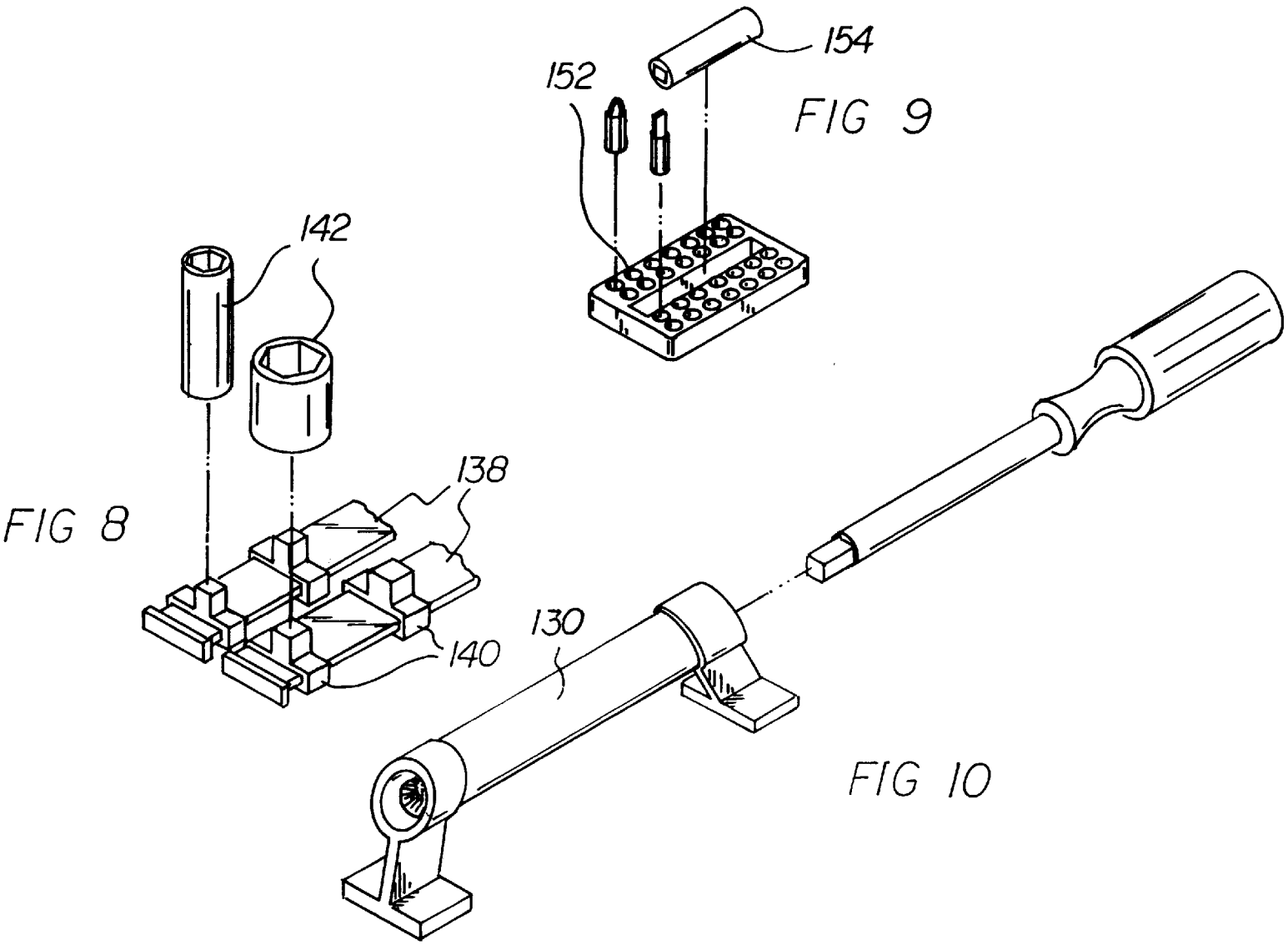
FIG. 8 is a perspective illustration of coupling members for socket heads.
FIG. 9 is a perspective illustration of a holder for bits.
FIG. 10 is a perspective illustration of a handle.

Referring now first to FIGS. 1–3, the tool carrier 1 of the invention provides a secure holder for sets of sockets 23, socket wrench elements such as extensions and adapters, not shown, and ratchet handles 20 for use with the various sized sockets. The carrier also securely holds a variety of elongate items such as the many varieties of end wrenches such as a fixed open end, adjustable open end, box wrenches and combinations thereof. These are all provided in easily seen positions so that they may be selected for use without having to rummage through a cluttered toolbox. They are held securely in position by resilient engagement with holding means so that if the carrier is upset, the various items remain in place. The carrier is provided with a centrally located handle 6 for carrying it about. It is also adapted for resting inside a toolbox 18 where it rests on projections 19 above the box contents in much the same manner as conventional tool trays that are provided with many toolboxes.

The carrier comprises an upper portion 2 having a broad surface area 5 with a long axis 3 and a short axis 4. A plurality of elongate support elements 7 are fastened to the surface 5. Slidably mounted on the support elements 7 are resilient receiver clips 8 for removably receiving the sockets 33 and holding them with spring bias. The clips 8 slide easily to adjust for spacing to accommodate sockets of different sizes. The sockets all have recesses 24 of the same size to fit the various wrenches 20. The resilient clip 8 compresses as the socket is forced over it. This holds the socket and also causes the grip of the clip on support 7 to tighten so that it doesn't slide about. An alternative socket clip 9 features a spring loaded ball detent 10. Also mounted atop upper portion 2 are a plurality of spring clips 17 of various sizes that are adapted for resiliently and removably engaging various wrenches and adapters such as those that are normally used with the sockets as exemplified by ratchet handle wrench 20.

Depending from upper portion 2 are two opposed sides 12. These are joined to lower panel 13, to define a broad shallow space 14 between the upper portion and the lower panel. On the lower panel is mounted a broad web 15 provided with resilient upstanding fibers 16. Outdoor carpeting has been found to be useful for this purpose. When elongate items such as the various end wrenches are pushed into the space 14, the fibers are bent down and resiliently hold the wrench up against the upper portion so that they will not fall out when the carrier is tilted. The end of the wrench 21 is left protruding so that it is easily seen and selected. Because both open ends of the space 14 are available, a large number of wrenches of assorted styles and sizes may be carried and displayed at once.

The carrier 1 may optionally be provided with a drawer 22 that is slidably mounted on an optional drawer support 25 that is hung below the lower panel.

Figure 4:
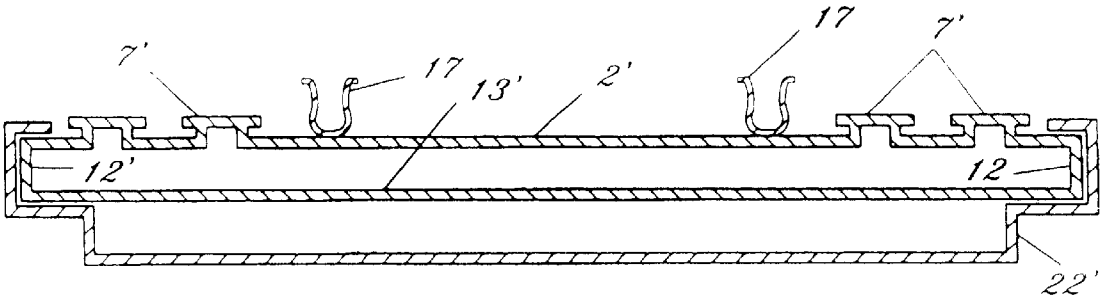
FIG. 4 is a sectional view of another embodiment of the invention.

Referring now to FIG. 4, an alternative construction is shown in which the elongate support elements 7', the upper portion 2', spring clips 17' and sides 12' and lower panel 13' are all integrally formed such as by extrusion. The drawer 22' is slidably mounted directly on the upper portion 2 so that when it is not used, there is no projection below the lower panel.

FIGS. 5 through 10 describe a further embodiment of the invention. As, described herein, the new and improved tool carrier system 100 comprises, in combination a lower rectilinear support 102. Such support has an upper plate 104 and a lower support plate 106. Each of these plates have a long length and a short width and with side plates 108 there between for forming an opening 110 through the support. The upper surface of the upper plate forms a recipient surface 112.

Additionally provided is an upper rectilinear support 116. Such support has an upper plate 118 and a lower support plate 120. Each of these plates has a long length and a short width and with side plates 122 there between for forming an opening 124 through the support. The upper surface of the upper plate forms a recipient surface 126. The length and width of the upper support are less than the length and width of the lower support.

Further provided is a handle 130. The handle is in a hollow cylindrical configuration. It forms a central opening 132 there within. The handle also has downwardly extending arms 134. Such arms are coupled to the ends of the upper surface of the upper support 116. The length of the handle is less than the length of the upper surface of the upper support. The center of the handle overlies the length-wise center of the upper and lower supports for ease of handling.

Additionally provided is a plurality of elongated support elements 138. Such elements are affixed to the upper surface of the lower support, two on each side. Such elements are laterally offset from the upper support. A plurality of receivers 140 are slidably received along the support elements and are provided with spring bias elements for securely holding socket 142 thereon. The receivers and spring bias elements are preferably constructed as in the prior embodiment herein above.

The upper and lower supports and handles are preferably fabricated of plastic for weight reduction. Such parts could, however, be readily fabricated of metal. In addition, two laterally spaced apertures, not shown are preferably formed through the lowermost plate adjacent one end for mounting on a wall.

A broad web 146 bearing upstanding resilient fibers is mounted on the lower surface of the openings through the lower support and upper support and also within the interior surface of the handle. This facilitates the removable receipt and sliding support of elongated tools.

Lastly provided is a generally rectilinear container 150. Such container is formed with rows and columns of cylindrical openings 152 having vertical axes. A central slot 154 is found there between for the removable receipt of bits.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tool carrier system comprising, in combination:

a lower rectilinear support having an upper plate and a lower plate, the upper plate and lower plate each having a long length and a short width and with side plates there between for forming an opening through the lower rectilinear support, the upper surface of the upper plate forming a central section with laterally offset side sections constituting recipient surfaces;

an upper rectilinear support having an upper plate and a lower region coextensive with the central section of the lower rectilinear support, the upper plate and the lower region of the upper rectilinear support each having a long length and a short width and with side plates there between for forming an opening through the support, the upper surface of the upper plate forming a recipient surface, the length and width of the upper support being less than that of the lower support;

a handle in a hollow cylindrical configuration to form a central opening there within and with downwardly extending arms coupled to the upper surface of the upper rectilinear support adjacent to the ends thereof, the length of the handle being less than the length of the upper surface of the upper support;

a plurality of elongated support elements affixed to each side of the upper surface of the lower support laterally offset from the upper support with a plurality of receivers being slidably supported along the support elements and provided with spring bias elements for securely holding sockets thereon;

a web bearing upstanding resilient fibers mounted on the lower surface of the openings through the lower support and upper support and within the interior surface of the handle for the removable receipt and sliding support of tools; and a generally rectilinear container upstanding from the upper rectilinear support with rows and columns of cylindrical openings having vertical axes and a central slot therebetween for the removable receipt of bits.

2. A tool carrier comprising:

a lower rectilinear support having an upper plate and a lower plate, each of the plates having a long length and a short width and with side plates therebetween for forming an opening through the lower rectilinear support, the upper surface of the upper plate forming a central section with laterally offset side sections constituting lower recipient surfaces;

an upper rectilinear support having an upper plate and a lower region coextensive with the central section of the lower rectilinear support, the upper plate and the lower region of the upper rectilinear support having a long length less than the length of the plates of the lower support and a short width less than the width of the plates of the lower support and with side plates therebetween for forming an opening, the upper surface of the upper plate forming an upper recipient surface, the length and width of the upper support being less than that of the lower support; and a handle operatively coupled to and extending above the upper surface of the upper support, the handle being in a hollow cylindrical configuration to form a central opening there within and with downwardly extending arms coupled to the ends of the upper plate of the upper rectilinear support, the length of the handle being less than the length of the upper plate of the upper rectilinear support.

3. The carrier as set forth in claim 2 and further including a plurality of elongated support elements affixed to the upper surface of the lower support laterally offset from the intermediate support with a plurality of receivers being slided along the support elements and provided with spring bias elements for securely holding thereon a socket.

4. The carrier as set forth in claim 2 and further including a broad web bearing upstanding resilient fibers mounted on the upper surface of the openings through the lower support and upper support and within the interior surface of the handle for the removable receipt and sliding support of tools.

5. The container as set forth in claim 2 and further including a generally rectilinear container with rows and columns of cylindrical openings having vertical axes and a central slot there between for the removable receipt of bits.

6. The carrier as set forth in claim 2 wherein the upper and lower supports are fabricated of plastic.

7. A tool carrier comprising:

an upper portion having a broad surface area with a long axis and a short axis;

a handle connected to the upper portion and extending upward therefrom;

plurality of elongate support elements attached to the upper portion and extending upward therefrom;

a plurality of receiver means for removably attaching to sockets, each receiver means being slidably mounted on one of said support elements and provided with spring bias means for securely holding thereon a socket;

two parallel opposed sides attached ot hte upper portion and extending downward therefrom;

a lower panel attached to the two sides and disposed beneath and parallel to the upper portion and spaced apart therefrom to define a broad shallow space therebetween with open ends parallel to the short axis and;

a broad web bearing resilient fibers mounted on the lower panel, the fibers cooperating with the upper portion to removably grip elongate items inserted through one of the open ends.

8. The tool carrier according to claim 7, further comprising a drawer support connected to the two sides and a drawer supported belw the lower panel and constructed for sliding in a direction parallel to the long axis.

9. The tool carrier according to claim 8, in which the web is outdoor carpet.

10. The tool carrier according to claim 9 provided with means for mounting in a toolbox.

11. The tool carrier according to claim 7 provided with means for mounting in a toolbox.

12. The tool carrier according to claim 7, in which the handle has a hollow cylindrical configuration defining a central elongate open passage provided with a web bearing resilient fibers for removable receipt and sliding support of tools therein.

13. The tool carrier according to claim 12 further comprising:

an upper plate having a broad surface area with a short axis short axis shorter than the short axis of the upper portion and a long axis, the upper plate interposed between the upper portion and the handle;

two parallel, opposed side plates attached to the upper plate and extending downward therefrom to connect to the upper portion between the elongate support elements to define a second broad shallow space with open ends parallel to the short axis; and a broad web with resilient fibers mounted within the second broad shallow space to removably grip elongate items inserted through one of the open ends.

14. The tool carrier according to claim 7 further comprising:

an upper plate having a broad surface area with a short axis shorter than the short axis of the upper portion and a long axis, the upper plate interposed between the upper portion and the handle;

two parallel, opposed side plates attached to the upper plate and extending downward therefrom to connect to the upper portion between the elongate support elements to define a second broad shallow space with the open ends parallel to the short axis; and a broad web with resilient fibers mounted within the second broad shallow space to removably grip elongate items inserted through one of the open ends.

* * * * *